US008939662B2

(12) United States Patent
Kaufman

(10) Patent No.: US 8,939,662 B2
(45) **Date of Patent: *Jan. 27, 2015**

(54) METHOD OF FORMING DOUBLE SIDE EXTENDED TAB LABEL WITH VERIFICATION OF PRESCRIPTION INFORMATION

(76) Inventor: Stacy R. Kaufman, Weston, FL (US)

( * ) Notice: Subject to any disclaimer, the term of this patent is extended or adjusted under 35 U.S.C. 154(b) by 436 days.

This patent is subject to a terminal disclaimer.

(21) Appl. No.: 12/778,324

(22) Filed: May 12, 2010

(65) Prior Publication Data

US 2010/0295916 A1 Nov. 25, 2010

Related U.S. Application Data

(63) Continuation of application No. 11/535,155, filed on Sep. 26, 2006, now Pat. No. 7,740,411, which is a continuation of application No. 10/687,005, filed on Oct. 16, 2003, now abandoned, which is a continuation-in-part of application No. 10/297,262, filed on Dec. 3, 2002, now Pat. No. 6,860,513.

(60) Provisional application No. 60/498,863, filed on Aug. 29, 2003, provisional application No. 60/419,066, filed on Oct. 16, 2002.

(51) Int. Cl.

| | |
|---|---|
| ***B41J 2/315*** | (2006.01) |
| ***G09F 3/02*** | (2006.01) |
| ***G09F 3/04*** | (2006.01) |
| ***G09F 3/10*** | (2006.01) |
| ***B42D 15/00*** | (2006.01) |

(52) U.S. Cl.
USPC ..... 400/120.01; 283/72; 283/81; 283/106

(58) Field of Classification Search
USPC ..... 399/411; 400/120.01
See application file for complete search history.

(56) References Cited

U.S. PATENT DOCUMENTS

| | | | | |
|---|---|---|---|---|
| 3,077,684 | A * | 2/1963 | Gwinn | 40/662 |
| 4,061,808 | A | 12/1977 | Sato | |
| 4,128,954 | A * | 12/1978 | White | 40/310 |
| 4,312,523 | A * | 1/1982 | Haines | 40/630 |
| 4,324,058 | A * | 4/1982 | Sherwick et al. | 40/310 |
| 4,584,219 | A * | 4/1986 | Baartmans | 428/42.3 |
| 4,895,747 | A | 1/1990 | Birkholz et al. | |
| 4,927,179 | A * | 5/1990 | Ehret et al. | 283/79 |
| 5,056,827 | A * | 10/1991 | Sasso | 283/105 |
| 5,328,208 | A * | 7/1994 | Garrison | 283/105 |
| 5,342,093 | A * | 8/1994 | Weernink | 283/81 |

(Continued)

FOREIGN PATENT DOCUMENTS

| | | | | |
|---|---|---|---|---|
| DE | 3924790 A * | 2/1991 | | B65D 1/02 |

OTHER PUBLICATIONS

Machine Translation of DE 3924790 A, EPO, Oct. 2008.*

*Primary Examiner* — Nguyen Ha
(74) *Attorney, Agent, or Firm* — Southeast IP Group; Thomas L. Moses

(57) ABSTRACT

A method of forming an extended tab label is disclosed. The method includes the steps of providing a paper supply to a printer, the paper supply having an adhesive covering at least a portion thereof. Inputting patient-specific information through a computer to the printer. Printing the patient-specific information on the paper supply, where the paper supply containing patient-specific information thereon forms a label having a length greater than a circumference of a container accepting the label.

16 Claims, 5 Drawing Sheets

(56) References Cited

U.S. PATENT DOCUMENTS

| | | | | | |
|---|---|---|---|---|---|
| 5,704,648 | A * | 1/1998 | Brown et al. | ..... | 283/81 |
| 5,775,735 | A * | 7/1998 | Bolnick et al. | ..... | 283/81 |
| 5,782,496 | A * | 7/1998 | Casper et al. | ..... | 283/81 |
| 6,021,942 | A | 2/2000 | Monico | | |
| 6,125,563 | A * | 10/2000 | Girerd | ..... | 40/310 |
| 6,364,364 | B1 * | 4/2002 | Murphy | ..... | 283/79 |
| 6,544,925 | B1 * | 4/2003 | Prusik et al. | ..... | 503/201 |
| 6,680,098 | B1 * | 1/2004 | Aakermann | ..... | 428/40.1 |
| 6,733,855 | B1 * | 5/2004 | Scott | ..... | 428/40.1 |
| 6,737,137 | B2 * | 5/2004 | Franko et al. | ..... | 428/40.1 |
| 7,016,752 | B1 * | 3/2006 | Ruben et al. | ..... | 700/117 |
| 2002/0185856 | A1 | 12/2002 | Hanefeld et al. | | |
| 2003/0017293 | A1 * | 1/2003 | Franko et al. | ..... | 428/41.8 |

* cited by examiner

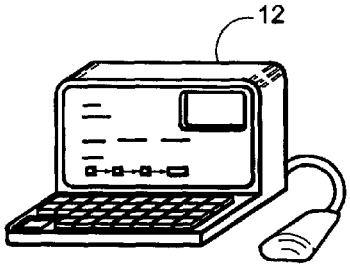
FIG.1
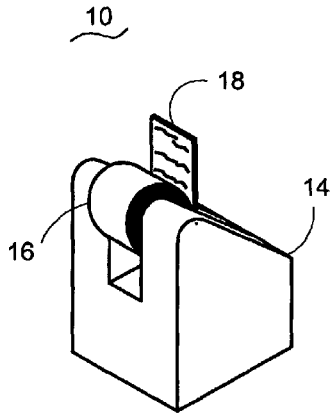
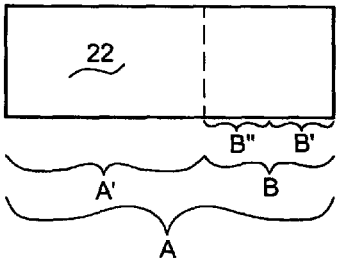
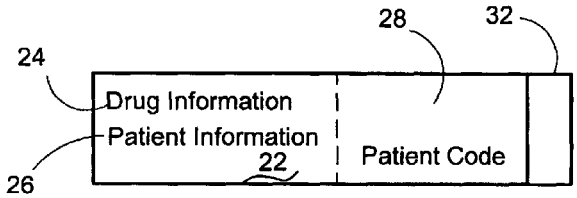
FIG.1a
FIG.2a
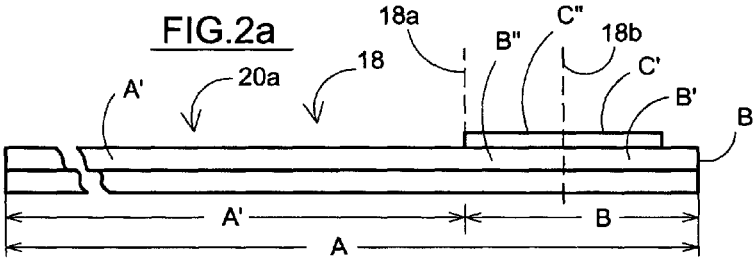
FIG.2b
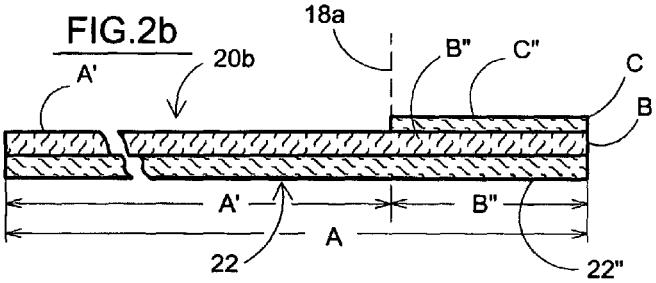
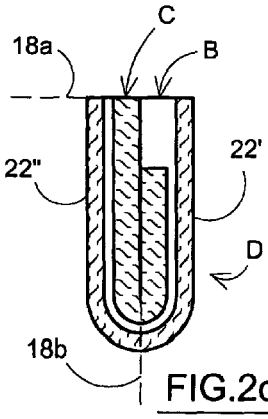
FIG.2c

METHOD OF FORMING DOUBLE SIDE EXTENDED TAB LABEL WITH VERIFICATION OF PRESCRIPTION INFORMATION

CROSS-REFERENCE TO RELATED APPLICATIONS

This is a Continuation application of co-pending U.S. Non-provisional Application Ser. No. 11/535,155, filed on Sep. 26, 2006, entitled METHOD OF FORMING DOUBLE SIDE EXTENDED TAB LABEL WITH VERIFICATION OF PRESCRIPTION INFORMATION, which is a continuation application of non-provisional Nonprovisional application Ser. No. 10/687,005, filed on Oct. 16, 2003, entitled VERIFICATION OF PRESCRIPTION INFORMATION WITH DOUBLE SIDE EXTENDED TAB LABEL AND METHOD OF FORMING THE SAME, which is a continuation-in part of Nonprovisional application Ser. No. 10/297,262, filed on Dec. 3, 2002, entitled VERIFICATION OF PRESCRIPTION INFORMATION AND WARNING LABEL, and claims the benefit of Provisional Application Ser. No. 60/498,863, filed on Aug. 29, 2003, entitled METHOD OF FORMING AN EXTENDED TAB LABEL and U.S. Provisional Application Ser. No. 60/419,066, filed on Oct. 16, 2002, entitled VERIFICATION OF PRESCRIPTION INFORMATION WITH DOUBLE SIDE PRINTING WARNING LABEL. The contents of all the prior applications are incorporated herein in their entirety.

TECHNICAL FIELD OF THE INVENTION

The present invention relates to label printing. In particular, the present invention relates to a method of printing on both sides of extended tab labels, such as by using a label role and thermal transfer or direct thermal printing. In addition, the present invention relates to printing on the liner of a dual web laser form disclosed in the above referenced '262 application.

BACKGROUND OF THE INVENTION

In the pharmaceutical industry, a pharmacist dispenses medicines and drugs to consumers. Typically, a manufacturer makes these medicines and drugs. A physician generally writes a prescription to the patient/consumer who takes the prescription to the patient's pharmacist where the prescription is filled.

This invention is primarily directed to those medicines and drugs that are ingestible, that are dispensed in a pill and tablet form, a liquid, or topical lotions.

Generally, pills and tablets come in a myriad of shapes and colors, some with markings thereon from the manufacturer, and liquids also come in colors. These markings represent information and may include numbers, letters, color and other indicia, etc.

Additionally, at the time of filling the prescription additional information is provided to the patient/consumer regarding information, warnings and directions regarding use of and taking of the prescribed medicine (hereinafter information). It is desirable to attach this information to the container for the medication for the patient, and it has now become a requirement in some states for this information to appear and be affixed to the container-of the medication. This information is specific to the patient and to the dispensed medication. Therefore the information can only be determined at the time of dispensing the medication to the patient. The filler of the prescription, e. g. the pharmacist or the pharmacist's technician, must make the determination of the disclosed information at time of filling the prescription. However there is more information required than there is space on the container to place the information in a visually readable format. Additionally, new regulations may require laws and manufacturers of medicines to place more information on the container label.

These prescription labels are typically placed on a cylindrical medicine container having a replaceable top that typically screws on or snaps onto the container to seal it. The containers are often called vials and are of a variety of sizes, a common size, but not limited to this size, is nine (9) drams. For this size vial a typical label has an adhesive backing and is three and one quarter (3 ¼) inches wide and two (2) inches tall.

Pharmacies are also verifying prescription medications more often to reduce medical errors that occur in the fast paced world of drug dispensing. It is believed that time constraints prevent pharmacists from implementing more error-prevention procedures.

The present invention, a label format, offers an information tab providing additional printable space and informational space that will allow the pharmacist, pharmacy technicians and the consumer to visually verify that the medication prescribed is exactly what it is supposed to be, as well as provide more printed information for the consumer. This provides the fastest, easiest system to reduce errors where errors are unacceptable.

The present invention provides a solution to problems associated with drug dispensing; wrong dosage, wrong drug given, wrong route of administration, failure to warn patients of potential hazards and proper instructions on use. This removes any inhibitions of implementation of medication error-prevention procedures, satisfying the work overload and constant time pressures in today's pharmacies and hospitals.

The enlarged label format of the present invention provides legibility of the medication specifics; visual verification for accuracy in medication; visual representation may satisfy current OBRA 90 laws (4) on verbally informing the patient of the medication they are receiving; specific clock designation for accurate use of medication; simplifies the Warnings and Indications labeling required for each individual medication; flexibility for multiple languages; NDC code number for obtaining all of the specific properties of the medication; UPC bar code for confirming drug medication for verification procedures as well as constant inventory management for a controlled substance; enhances product compliance features; and is a solution for error-prevention procedures in medication dispensing.

Pharmacists use pharmacy systems to check, verify and recheck that the proper medicine/drug prescribed is actually filled into the container. These systems may be manual or written as have been practiced for years and may be paper systems or computerized systems. However, what is lacking is a way for a consumer, typically the patient, to make his or her own verification that the proper medicine has been dispensed.

In the prior art of pharmaceutical labels it is known to use laser print forms such as those sold by Convergent Label Technology, of Tampa, Fla. These type of forms provide a pharmaceutical label attached at the top of a sheet of paper, generally 8 ½ inches by 11 or 14 inches, that is capable of being loaded into a sheet fed printer, such as a laser printer or ink jet printer, known in the art and which are sheet fed, one at a time from a stack of preloaded sheets in the printer. The pharmaceutical label then has information printed thereon by the printer. Thereafter, the label contains the prescription and other information. The label is then peeled off and placed on a medicine container by the pharmacist or the pharmacist's assistant. Typically, these labels are placed around the circumference of the container and have, when attached to the sheet of paper, a pressure sensitive backing to allow the label to be peeled from the sheet of paper and then attached by the adhesive to the container. However, the labels are limited to attachment directly to the container and there is no provision for an information tab as in the present invention.

U.S. Pat. No. 5,601,314 provides a label that requires multiple folds and layers to be attached to the container. Specifically, by removing the top face 22, record 26 is detached for placement on a record keeping log and portion 28 is likewise removable by the patient. This teaches away from the present invention by not keeping all record information visible with the container. The present invention does not require multiple layers of the label to be attached to the container.

U.S. Pat. No. 5,056,827 provides a manufactures' label for use to be affixed by a drug manufacturer as a description and instruction label for the pharmacist. It generally requires preprinting on both sides of the label sheet. It is intended to be removed to leave space for affixing the pharmacy's own standard type of prescription label. The present invention does not require printing on both sides of the label that would require an extra step.

The label disclosed in U.S. Pat. No. 5,056,827of is a preassembled and pre-folded label by a label machine and is not folded by hand.

U.S. Pat. No. 4,324,058, discloses a label for undersized containers, that wraps around the container and adheres one end of the label to the other end of the label, without regard to the actual circumference of the container being used. This label requires printing on the label to correspond to the container size. It also requires an exact alignment of the two loose ends so that there is no exposed adhesive. The '058 patent requires a determination of a middle point of the label for accurate alignment, not required in the present invention. Likewise the present invention allows for easier attachment of the label.

U.S. Pat. No. 4,312,523 discloses a pharmaceutical label, having a pull tab 18 for tearing off a first and second detachable section of the label. This is contrary to the present invention, which does not require removal of a part of the label.

U.S. Pat. Nos. 5,645,300, 5,727,819, 5,263,743, Re.34, 366, 5,472,756, and 4,621,837 are all preprinted self adhesive labels, printed one at a time, and are printed at or about the time of dispensing the medicine in the container. U.S. Pat. No. 1,756,944 is a two sided label, and U.S. Pat. No. 3,077,684 a luggage tag label, is similar to U.S. Pat. No. 4,324,058 that has a center portion with no adhesive and two loose ends that must be placed together. None of the prior art teaches or suggests the novelty of the present invention.

U.S. Pat. No. 6,036,017 discloses a label bearing a visual photographic image of a pill. However, it does not teach extending a label for additional information as in the present invention.

Additionally, over the last two decades, the use of thermal systems to generate images on various types of paper stocks has significantly increased due to various advantages for particular applications. There are two basic types of thermal systems, thermal transfer systems in which a material is transferred from one stratum to a stock sheet, and direct thermal transfer in which a thermosensitive coating is provided on the stock and indicia formed by chemical or physical processes in the coating as a result of bringing particularly shaped thermal elements into contact with the stock. Both systems use thermal print heads consisting of miniature resisters that are either in a straight line or a matrix, and become heated in response to current pulses.

One particular area where thermal printing has been used advantageously is in the printing of baggage tags, such as for airlines or trains. Tags made of direct thermal stock may be simply produced on site to include a wide variety of variable images, including bar coding.

The prior art, however, does not address the need for an on-demand, real-time printing of an extended tab label for pharmacy applications.

SUMMARY OF THE PRESENT INVENTION

The present invention eliminates the above-mentioned needs for an on-demand, real-time printing of an extended tab label for pharmacy applications by providing an on-demand, real-time printing of an extended tab label for pharmacy applications that utilizes a printing system, such as thermal transfer or direct thermal printing, or ink jet or laser printing systems.

In accordance with the present invention, there is provided a method of forming an extended tab label for use in a pharmacy. The method includes the steps of providing a paper supply to a printer, the paper supply having an adhesive covering at least a portion thereof. Inputting patient-specific information to the printer. Printing the patient-specific information on the paper supply, where the paper supply containing patient-specific information thereon forms a label having a length greater than a circumference of a container accepting the label.

In accordance with another feature of the invention, the paper supply is thermal paper.

In accordance with an additional feature of the invention, the printer is selected from the group consisting of thermal, laser, and inkjet printers.

In accordance with yet an additional feature of the invention, the label has a front face and a rear face, the rear face has an adhesive backing. The label has a first portion affixed by the adhesive around at least a portion of the circumference of the container with the front face facing outward from the container. The label has a second portion which projects radially outward from the container. The front face portion of the first portion and the second portion have information thereon.

In accordance with a further feature of the invention, the method includes the printing of drug information on the thermal paper supply.

In accordance with yet another feature of the invention, the printed label is adhered to a medicinal container.

In accordance with still yet another feature of the invention, the medicinal container is cylindrical.

In accordance with another mode of the invention, there is provided a method of forming an extended tab label. The method includes providing a thermal paper supply to a thermal printer. The thermal paper supply has an adhesive covering at least a portion thereof. Inputting patient-specific information through a computer to the thermal printer. Printing the patient-specific information on the thermal paper supply, wherein the thermal paper supply containing patient-specific information thereon forms a label having a length greater than a circumference of a container accepting the label. Removing the printed label from the thermal printer.

In accordance with still another feature of the invention, the thermal printer is a direct thermal printer.

In accordance with yet a further feature of the invention, the thermal printer is a thermal transfer printer.

Furthermore, the present invention provides a means for easy application of the prescription label onto the container.

The present invention is a method of providing sufficient space on a label to allow a consumer to be clearly informed and be able to recognize and validate the image of prescribed medicine, the dosage amount, the prescribed brand, how to take the medicine, when to take the medicine, the drug manufacturer, possible side effects of the medicine, information on the time to take the medication and to receive other information and warnings about the prescribed medicine and the prescription.

The present invention provides an independent means for the consumer to verify that the proper medicine has been dispensed and provides additional information to verify the medicine and provide additional information from the pharmacy or dispenser of the medicine. One part of the invention is that it allows the consumer to visually verify that the type of pill or tablet named on the prescription label has in fact been dispensed. This visual verification uses an actual photograph of the medicine, and/or an imprint or drawing or other facsimile to depict the actual drug dispensed in the container. This will allow the pharmacist and the consumer an easy means to verify that the proper medicine has been dispensed to the patient. This additional complete information and warnings can be placed on the prescription label because of the increased size of the label.

The pharmacist will receive information from the physician to fill the prescription. This may be in the form of a written "prescription" given to the pharmacist or the may be delivered to the pharmacist electronically or by some other method, outside the scope of this invention. Typically the pharmacist will enter the information from the prescription into the pharmacist's computer or system. A label for placement on the medicinal container will be created. The system computer will print out the label to be placed on the container for the medicine.

The pharmacist will enter information from the prescription and the identification of the medicine to be dispensed, to fill the prescription. This information will be used for printing of the label and will be used to identify the prescribed medicine.

The pharmacist's database of information will have separate information that may be obtained directly from the manufacturer or provider or other information provider, regarding the dispensed medicine. The database would link the description of the medicine that the pharmacist entered into the pharmacist's computer with the information from the database for the prescribed medicine. Then on a separate portion of the label, a written description of the dispensed medicine, e.g., the physical format of the medicine and attributes of the physical characteristics of the medicine, along with a photograph or image of the medicine, will be printed on the label, preferably the tab portion that extends from the container for the medicine.

Additionally, warning information and other information can now be provided on the label and the information tab of the present invention. It being understood that information and warnings can be placed anywhere on the entire label.

Additional information printed on the label includes the doctor's instructions and information as well as common information input by the pharmacist if desired based on the pharmacist's professional responsibilities and according to the patient's requirements.

Although the invention is illustrated and described herein as embodied as a method of making an extended tab label, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 1 is a diagrammatic illustration of the preferred embodiment of the present invention, showing a computer input device, a printer and a label.

FIG. 1*a* is a front view of label 18 of the preferred embodiment of the present invention.

FIG. 2*a* is a side view of the label 18 of FIG. 1.

FIG. 2*b* is an illustration of an alternative embodiment of the label of FIG. 1.

FIG. 2C is a side view of the folded extendable tab portion of label 18 of the present invention.

DETAILED DESCRIPTION OF THE PREFERRED EMBODIMENT

Figure 3:
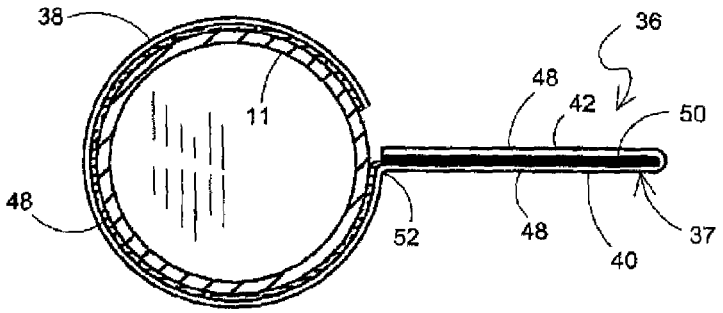
FIG. 3 is a top view of an alternative embodiment of the label of FIG. 1.
Figure 4:
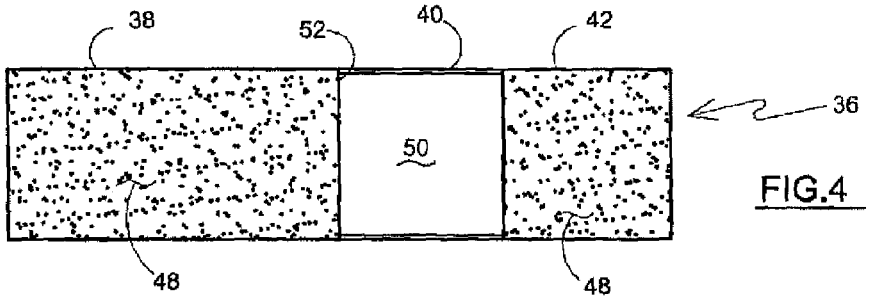
FIG. 4 is a rear view of the label of FIG. 3.

Referring now to FIG. 1, the preferred embodiment of the present invention is shown as extended tab label process or method 10. Extended tab label process or method 10 has a user or other input means, e.g. robotic electronic input, inputting patient-specific information into a computer 12. Computer 12 transmits the patient-specific information to a thermal printer 14. Thermal printer 14 includes a thermal paper supply 16, which can contain a core 16*a*, a liner 16*b* having a wax or silicone coating, and an adhesive backed thermal paper 16*c*. Although, a thermal printer is preferred, numerous other printers are acceptable and contemplated for use in the present invention, such as inkjet printers, laser printers, and the like. Upon receipt of the patient-specific information, thermal printer 14 prints the patient-specific information on the thermal paper 16*c*, forming a label 18 containing patient-specific information thereon and having a length greater than a circumference of a container accepting label 18 that is printed on demand in real-time.

Referring to FIG. 2*a*, label 18 has a first vertical score line 18*a* and a second vertical score line 18*b*. Label 18 has a first side 20*a*. Label 18 has a length A that is greater than the circumferential distance of the container that accommodates label 18. First side 20*a* has a first adhesive portion A' and a second adhesive portion B. First adhesive portion A' (the back of the front of the label 18) adheres to less than a full circumference of the container or bottle, leaving second adhesive portion B extending off of the container or bottle.

Second adhesive portion B can be utilized in several manners that are discussed below.

Folded Extendable Tab

Second adhesive portion B includes adhesive portion B' that can further include an attached liner C' and an adhesive portion B" that includes an attached liner portion C". Portion B' of label 18 can be folded over onto portion B" of label 18 forming an extendable tab portion of B' and B" back to back so that the front label portions 22' and 22" are exposed as part of the folded extendable tab D shown in FIG. 2*c*. The extended tab permits the user, such as a pharmacist or technician, to reposition portion B' with respect to portion B" to form a better alignment because the attachment portions of this tab are substantially the adhesive B"' to liner C". As shown in FIG. 1*a*, the extending tab displays drug information 24 and patient information 26, as well as other information such as advertising and the like, that is printed on second side 22, second side 22 opposite to first side 20*a*.

Second side 22 can additionally include region 28, which corresponds to portion B of first side 20*a*, for displaying a patient code, such as a bar code or other patient identifier, as well as patient scribing region 32. Patient scribing region 32 provides a space for a patient to write information on region 28 that will help the patient understand drug information 24 and patient information 26.

Non-Folded Extended Tab

Referring now to FIG. 2*b*, an alternative embodiment of label 18 is illustrated. In the alternative embodiment, a first side 20*b* has a length A that is greater than the circumferential distance of the container that accommodates label 18. First side 20*b* has a first adhesive portion A' and a second portion B" because in this embodiment, liner C" remains affixed to label portion B" of label 18. First adhesive portion A' adheres to less than a full circumference of the container or bottle, leaving second non-adhesive portion B" with liner C" attached, extending off of the container or bottle. Adhesive portion A' displays drug information 24 and patient information 26, as well as other information such as advertising and the like, that is printed thereon. As with the liner C' of portion B' described above, portion B" or facia 22" can contain and display preprinted information. This allows for an extended tab having information displayed on each side of the tab and does not require any folding over of one portion of an extended tab to another portion of the extended tab. In this embodiment, the extended tab has printed material on facia 22" and on liner C".

In this manner the tab portion, having surfaces 22" and C" can include printed information on both sides thereof, either by pre-printing one side earlier and the printing the other side at a point in time thereafter or by running the entire label through a duplexing printer.

Additionally, the present invention improves upon the above-referenced co-pending U.S. nonprovisional application Ser. No. 10/297,262 ('262), which is herein incorporated by reference. Referring to the drawings and like numbers in the figures for the copending nonprovisional patent application, including FIGS. 12, 13, 14, 14*a*, 14*b* and 15, FIGS. 3, 4, 5, 5*a*, 5*b* and 6, respectively, the label 36 is printed on a laser dual web form label sheet 44. As explained in the copending application incorporated by reference herein, label 36 is attached by adhesive 48 to a backing liner sheet 50. The adhesive 48 remains attached to label 36, when label 36 is removed from liner sheet 50.

In the prior art printing process, printing is directed to the front side 38 of the label 36, such that the printing is on the front side of label 36 and not on the rear side of the liner sheet 50.

The present invention engages printers that are used to do the above described printing and can print on both sides of a sheet, e.g. paper, or as in the present case, the front side and the rear side of the label sheet 44.

Figure 5:
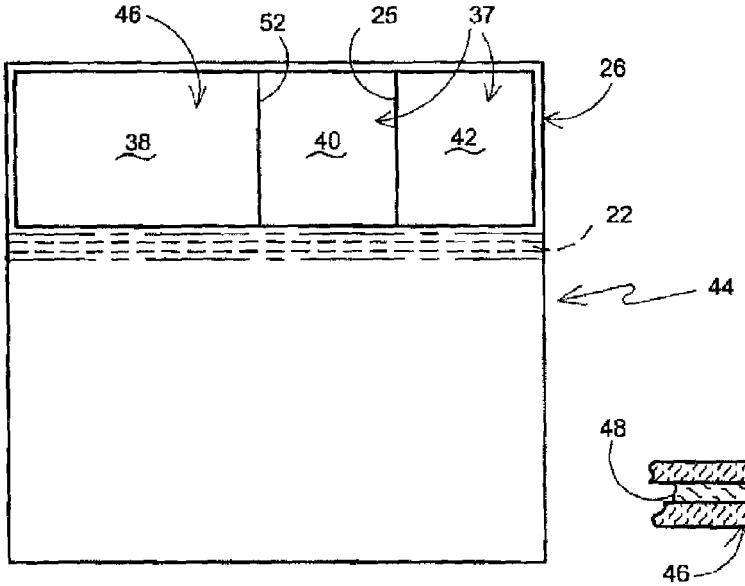
FIG. 5 is a front view of a laser dual-web form label combination sheet.
Figure 6:
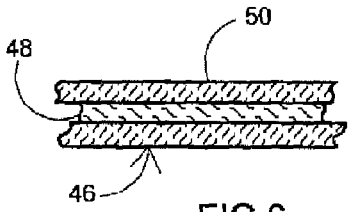
FIG. 6 is a sectional view of the laser dual-web form label combination sheet of FIG. 5.
Figure 5A:
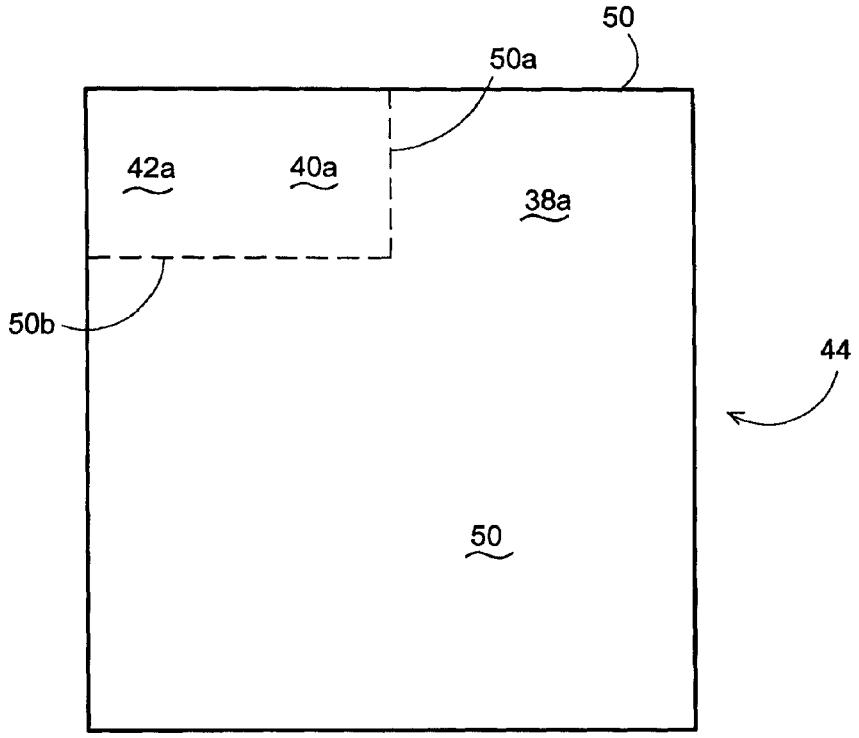
FIG. 5*a* is a front view of another laser dual-web form label combination sheet.

The improvement provides for cutting two cuts, 52*a* and 52*b*. The first cut is along line 52 cut out a portion of the backing liner sheet 50 along line 52 and along the exterior rear lines of facia 40*a* of front facia 40 and rear facia 42*a* of front facia 42 as shown on the attached FIG. 5*a*. The FIGS. 5 and 5*a* are formed such that label 36 is along the top of sheet 44. In the event that the label 36 is lower on the sheet 44, then at least an additional cut would be parallel to line 52*b* along the top portions of 40*a* and 42*a*.

Figure 5B:
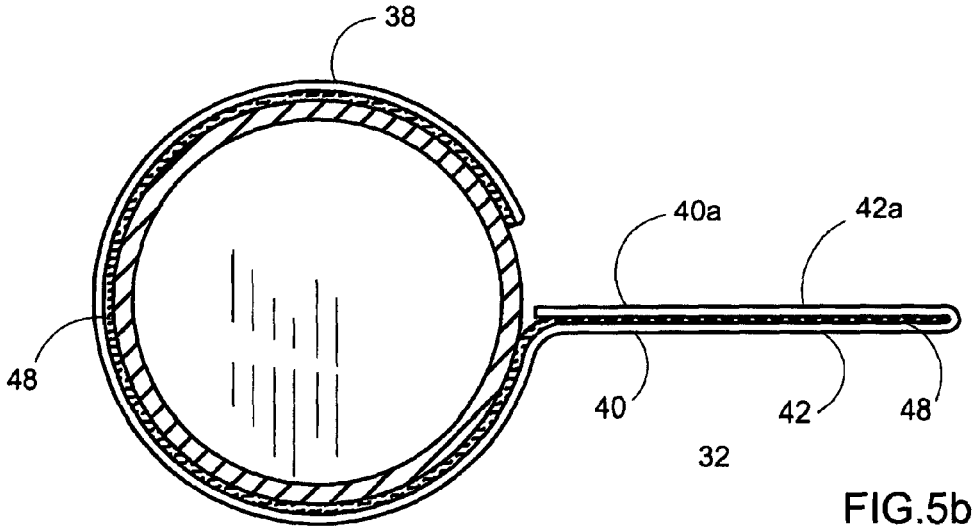
FIG. 5*b* is a top view of an alternative embodiment of the label of FIG. 1
Figure 7:
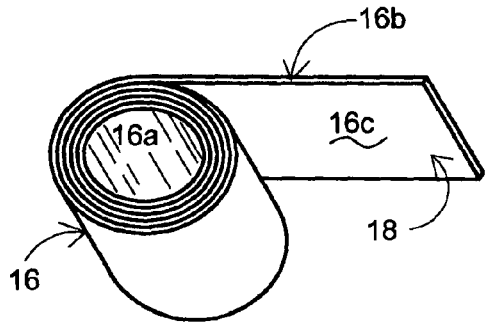
FIG. 7 is a perspective view of a thermal paper supply roll.
Figure 8:
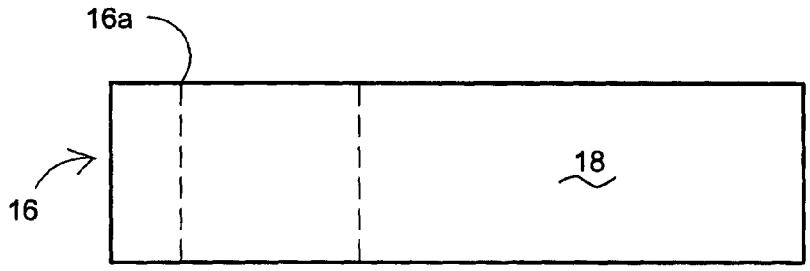
FIG. 8 is a top view of the thermal paper supply shown in FIG. 7.

Substantial advantages can now be provided with the ability to print on both sides of label sheet 44. These include having a longer informational tab 37. As shown in FIG. 5*b*, the tab 37 includes printing on facias 40, 42, 40*a* and 42*a*. Where label portions 38, 40 and 42 are to be printed on the front side of label sheet 44 and facias 40*a* and 42*a* are printed on the rear side of label sheet 44.

Label portion 38 and corresponding facia portion 38*a* and label portions 40 and 42 and corresponding facia portions 40*a* and 42*a* may be of different sizes and portions than shown in the drawings depending on container sizes, the areas to be covered and the amount of tab 37 desired. Likewise, portions 42 and 42*a* may be incorporated into or a part of portions 40 and 40*a* or visa versa.

Advantages include having the informational tab 37 also constructed and arranged to be torn off either in its entirety at line 52 or a portion of tab 37 can be torn off, to be used for example refills, coupons and for medication compliance requirements.

As disclosed in the '262 application the dual web label form can also be printed on both sides, such that printing is placed on the front of the label and on the lining of the label when it is scored along lines 50*a* and 50*b* as shown in FIG. 5*a* herein. So that the liner remains with the label portion and the printing on the liner appears to be on the back of the label.

Figure 9:
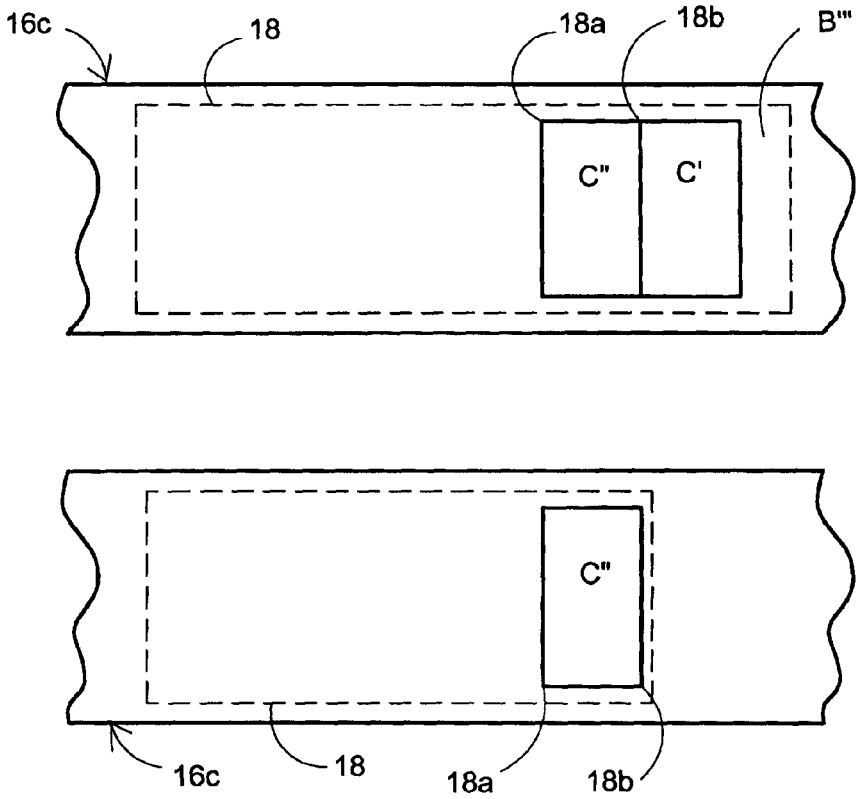
FIG. 9 shows the bottom views of the label and liner in the preferred embodiment and the alternative embodiment.
Figure 10:
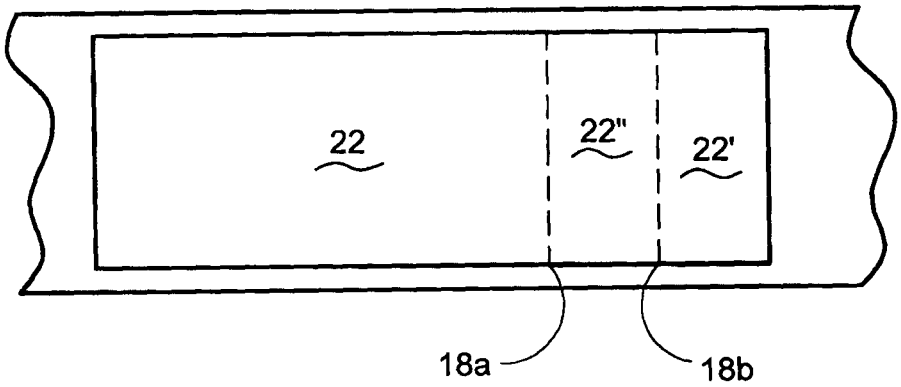
FIG. 10 shows the top views of the label and liner in the preferred embodiment and the alternative embodiment.
Figure 10:
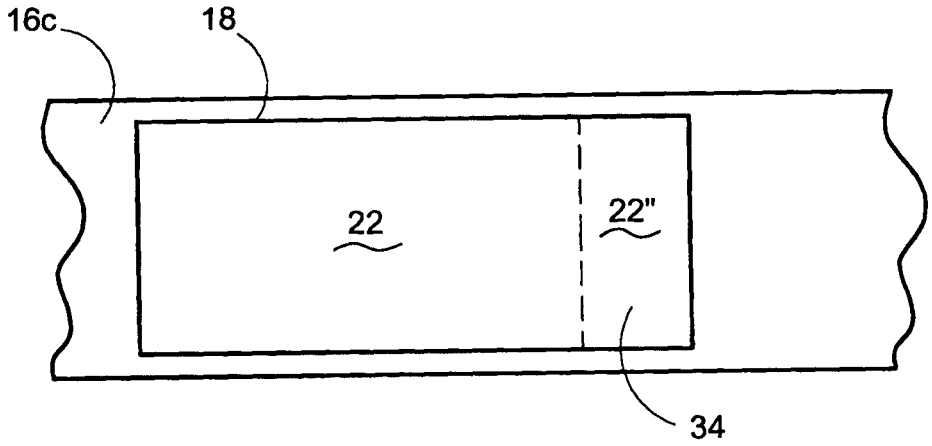

FIG. 9 shows the rear of label sheet 16*c* with liner cut outs C and C". Such that when label 18 is removed from label supply roll 16*c*, the liner cut outs C and C" stay with the label 18. FIG. 10 shows the front of the label sheet 16*c*.

Although only a few exemplary embodiments of the present invention have been described in detail above, those skilled in the art will readily appreciate that numerous modifications are to the exemplary embodiments are possible without materially departing from the novel teachings and advantages of this invention. Accordingly, all such modifications are intended to be included within the scope of this invention as defined in the following claims.

What I claim is:

1. A method of forming an extended tab label, the method comprising the steps of:

providing a paper supply to a printer, the paper supply including single sheets of paper having a front face and a rear face, the rear face having an adhesive on at least a portion of said rear face with a liner attached thereto, said liner including a score formed therein, the score defining a first label portion configured to dimensionally correspond to a circumference of a container and a second label portion;

inputting patient-specific information through a computer to the printer;

printing the patient-specific information on the paper supply, wherein the printed paper supply containing the patient-specific information thereon forms a label formed from one of said single sheets of paper with the adhesive and the liner disposed on the rear face thereof, and further having a length greater than the circumference of the container accepting the label;

and removing a portion of the liner from the first label portion and exposing the adhesive on the first label portion, such that the second label portion retains a remaining portion of the liner for allowing the second portion to project radially from the container.

2. The method according to claim 1 wherein the paper supply is thermal paper.

3. The method according to claim 1 wherein the printer is selected from the group consisting of thermal, laser, and inkjet printers.

4. The method of claim 1, wherein the first portion affixed by the adhesive around at least a portion of the circumference of the container with the front face facing outward from the container, and the front face portion of the first portion and the second portion have information printed thereon.

5. The method of claim 1, further comprising the printing of drug information on the thermal paper supply.

6. The method of claim 1, wherein the printed label is adhered to a medical container.

7. The method of claim 6, wherein the medical container is cylindrical.

8. The method of claim 1, wherein the first label portion and the second label portion have a same width and the score substantially extends across the width.

9. The method of claim 1, wherein only the front face of the first portion and the second portion have information printed thereon.

10. The method of claim 1, wherein information is printed on the front face portion of the first portion and the second portion, and wherein information is also printed on the liner of the second portion.

11. A method of forming an extended tab label, the method comprising the steps of:

providing a thermal paper supply to a thermal printer, the thermal paper supply comprising a single layer of thermal paper having an adhesive backing covering at least a portion thereof, said adhesive backing having a liner thereon with a score formed therein, the score defining a first label portion of configured to dimensionally correspond to a circumference of a container and a second label portion;

inputting patient-specific information through a computer to the thermal printer;

printing the patient-specific information on the thermal paper supply, wherein the printed thermal paper supply containing patient-specific information thereon forms a printed label having a length greater than the circumference of the container accepting the label, and removing the printed label from the thermal printer; and removing a portion of the liner from the first label portion and exposing the adhesive backing on the first label portion, such that the second label portion retains a remaining portion of the liner for allowing the second portion to project radially from the container.

12. The method of claim 11, wherein the thermal printer is a direct thermal printer.

13. The method of claim 11, wherein the thermal printer is a thermal transfer printer.

14. The method of claim 11, wherein the first label portion and the second label portion have a same width and the score substantially extends across the width.

15. The method of claim 13, wherein only the front face of the first portion and the second portion have information printed thereon.

16. The method of claim 13, wherein information is printed on the front face portion of the first portion and the second portion, and wherein information is also printed on the liner of the second portion.

* * * * *